US006859958B2

(12) United States Patent
LaMantia

(10) Patent No.: US 6,859,958 B2
(45) **Date of Patent: *Mar. 1, 2005**

(54) CRIB AND PLAYPEN PROTECTIVE ENCLOSURE

(76) Inventor: Mark LaMantia, 290 Broadway, Suite 404, Methuen, MA (US) 01844

( * ) Notice: Subject to any disclaimer, the term of this patent is extended or adjusted under 35 U.S.C. 154(b) by 1 day.

This patent is subject to a terminal disclaimer.

(21) Appl. No.: 10/413,816

(22) Filed: Apr. 11, 2003

(65) Prior Publication Data

US 2003/0177576 A1 Sep. 25, 2003

Related U.S. Application Data

(63) Continuation-in-part of application No. 10/040,705, filed on Jan. 7, 2002, now Pat. No. 6,550,083.

(51) Int. Cl.[7] ..... A47D 7/00
(52) U.S. Cl. ..... 5/97; 5/414; 5/93.1; 135/96
(58) Field of Search ..... 5/97, 414, 416, 5/424, 93.1, 948; 135/96

(56) References Cited

U.S. PATENT DOCUMENTS

| | | | | |
|---|---|---|---|---|
| 2,128,978 A | | 9/1938 | Akin | |
| 2,566,790 A | | 9/1951 | Bloomfield | |
| 2,927,331 A | | 3/1960 | Virginia | |
| 3,165,760 A | | 1/1965 | Abajian | |
| 3,605,140 A | | 9/1971 | Wanner | |
| 3,675,667 A | | 7/1972 | Miller | |
| 3,990,463 A | | 11/1976 | Norman | |
| 4,017,917 A | | 4/1977 | Brown | |
| 4,232,415 A | | 11/1980 | Webber | |
| 4,370,765 A | | 2/1983 | Webber | |
| 4,745,936 A | | 5/1988 | Scherer | |
| 4,823,415 A | | 4/1989 | Lampard | |
| 4,862,534 A | | 9/1989 | Gomez-Marcial | |
| 4,945,584 A | * | 8/1990 | LaMantia | 5/97 |
| 5,014,728 A | | 5/1991 | Arnold | |
| 5,161,261 A | | 11/1992 | Kamata | |
| 5,161,269 A | * | 11/1992 | McLean et al. | 5/97 |
| 5,163,461 A | | 11/1992 | Ivanovich et al. | |
| 5,396,917 A | | 3/1995 | Hazinski et al. | |
| 5,511,572 A | | 4/1996 | Carter | |
| 5,517,707 A | * | 5/1996 | LaMantia | 5/97 |
| 5,575,025 A | | 11/1996 | Peters | |
| 5,632,293 A | | 5/1997 | Carter | |
| RE35,571 E | | 7/1997 | McLeese | |
| 5,645,096 A | | 7/1997 | Hazinski et al. | |
| 5,683,199 A | | 11/1997 | Tehan | |
| 5,685,076 A | | 11/1997 | Curley et al. | |
| 5,809,592 A | | 9/1998 | McAllister | |
| 5,836,330 A | | 11/1998 | Franklin | |

(List continued on next page.)

FOREIGN PATENT DOCUMENTS

| | | |
|---|---|---|
| AU | D139199 | 12/1999 |
| AU | D141060 | 7/2000 |
| AU | D142055 | 10/2000 |

OTHER PUBLICATIONS

Master Ashley Baby Essentials from www.masterashley-.com, printed on May 25, 2000, 1 page.

(List continued on next page.)

*Primary Examiner*—Michael F. Trettel
(74) *Attorney, Agent, or Firm*—Wolf, Greenfield & Sack, P.C.

(57) ABSTRACT

An enclosure for a crib or playpen includes a dome-shaped top and a box-shaped bottom structure completely enclosing the interior of a crib or playpen. The enclosure includes a flap in the dome-shaped top to allowing a parent or guardian to easily place a child in or remove a child from the crib or playpen. The enclosure also has features which prevent a child from opening the flap.

19 Claims, 9 Drawing Sheets

U.S. PATENT DOCUMENTS

| | | | | | |
|---|---|---|---|---|---|
| 5,862,548 | A | | 1/1999 | Gerhart | |
| 5,881,408 | A | | 3/1999 | Bashista et al. | |
| 5,916,828 | A | | 6/1999 | Messner | |
| 5,921,260 | A | | 7/1999 | Carter | |
| 5,930,854 | A | | 8/1999 | O'Neill et al. | |
| 5,941,265 | A | | 8/1999 | Zheng | |
| 6,076,312 | A | | 6/2000 | Carter | |
| 6,109,280 | A | * | 8/2000 | Custer | 135/116 |
| 6,119,288 | A | | 9/2000 | Hendrickson | |
| 6,123,091 | A | * | 9/2000 | Flynn et al. | 135/96 |
| 6,131,127 | A | | 10/2000 | Gafken et al. | |
| 6,131,217 | A | | 10/2000 | Kasem | |
| 6,138,702 | A | | 10/2000 | Carter | |
| 6,192,535 | B1 | | 2/2001 | Warner, Jr. et al. | |
| 6,216,291 | B1 | | 4/2001 | Eads et al. | |
| 6,240,940 | B1 | | 6/2001 | Carter | |
| 6,263,894 | B1 | | 7/2001 | LaMantia | |
| 6,421,857 | B2 | * | 7/2002 | Whatman et al. | 5/663 |
| 6,425,150 | B1 | * | 7/2002 | Cheng | 5/97 |
| 6,467,107 | B1 | * | 10/2002 | Glover et al. | 5/99.1 |
| 6,550,083 | B1 | * | 4/2003 | LaMantia | 5/97 |

OTHER PUBLICATIONS

SpringboK Unique Self–Erecting Tent Structures from www.webcheckers.com/springbok.htm, printed on Mar. 5, 2003, 2 pages.

Tinker Tots Playhut, Jump–O–Lene, Bed Tents, Tunnels & More from www.tinkertots.com, printed on Mar. 3, 2003, 1 page.

planetBig innovative products from www.planetbig.com, printed on Mar. 3, 2003, 2 pages.

Promo Sports Self–Erecting Tents from www.asisupplier.com, printed on Mar. 2003, 2 pages.

DuneSport.net Kids Playhouse from www.dunesport.net, printed on Mar. 5, 2003, 1 page.

Happy Baby, Dos Baby Wear picture, and instructions for use, printed Mar. 2003, 1 page.

* cited by examiner

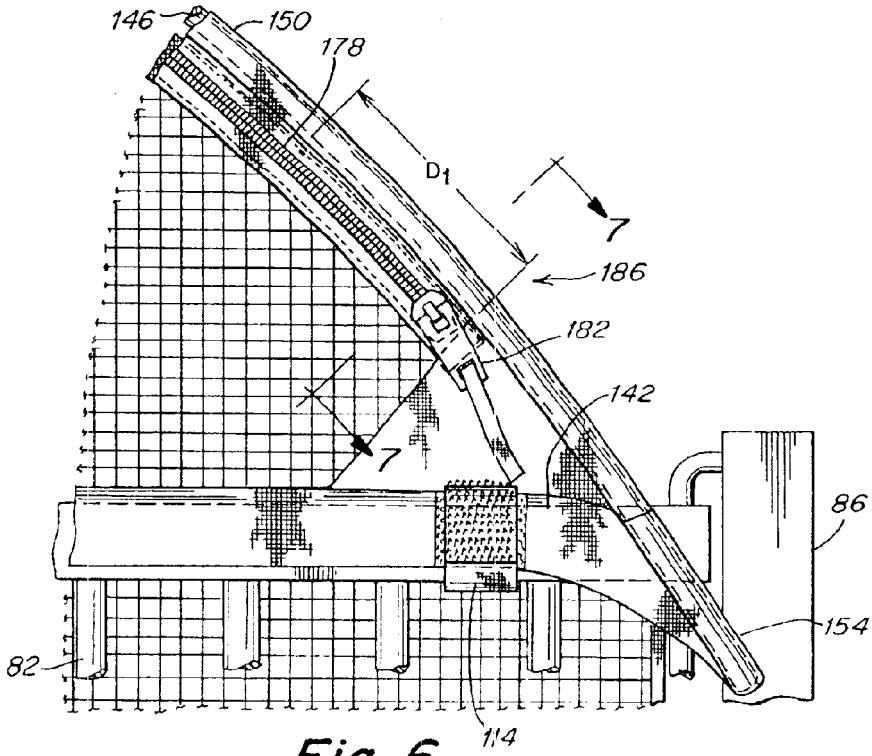
Fig. 6
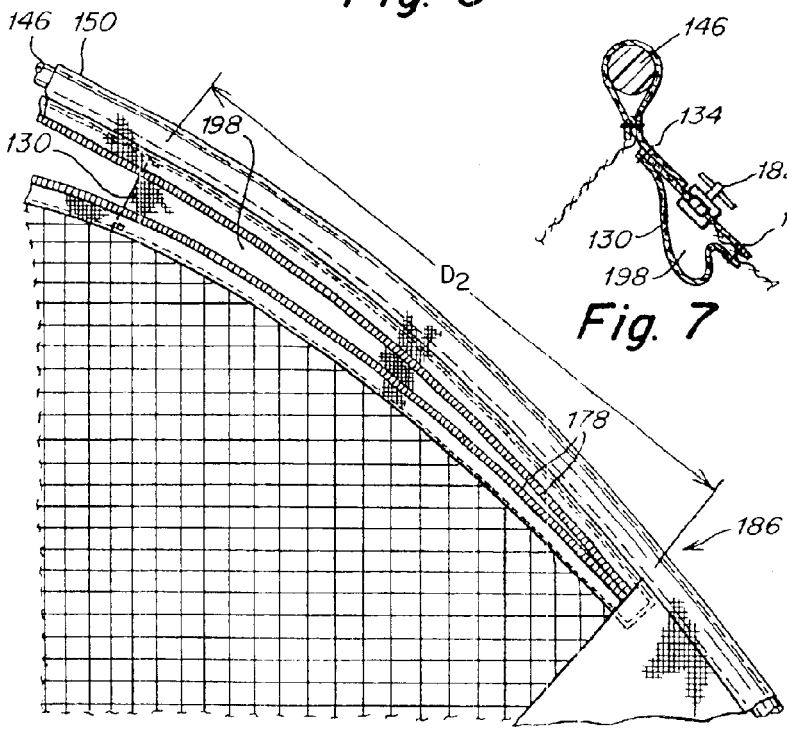
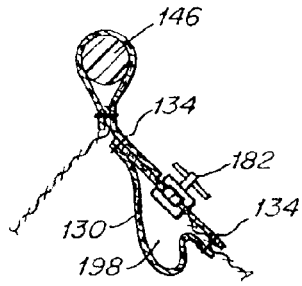
Fig. 7
Fig. 8

CRIB AND PLAYPEN PROTECTIVE ENCLOSURE

CROSS-REFERENCE TO RELATED APPLICATIONS

This application claims the benefit of and is a continuation-in-part of U.S. patent application No. 10/040,705 filed on Jan. 7, 2002 now U.S. Pat. No. 6,550,083.

FIELD OF THE INVENTION

This invention relates to a protective enclosure for cribs and playpens. In particular, it relates to an enclosure primarily comprising a fabric that encloses the interior of a crib or playpen.

BACKGROUND OF THE INVENTION

Cribs and playpens are frequently used to retain a child for relatively long periods of time while the child is either sleeping or awake and playing. Cribs are often used to minimize the amount of direct supervision a parent or guardian needs to give to a child by limiting the freedom of movement of the child. It is important that during these times of limited supervision, potential dangers be minimized without impairing access of the parent or guardian to the child, should it be needed. It is be noted that the terms "crib" and "playpen" are used interchangeably herein.

Cribs are often constructed in a box-like fashion with opposed solid headboards and footboards, opposed slatted side rails, and a solid bottom support. However, cribs and playpens do exist that have slatted head and footboards and non-solid bottoms. It is noted that the terms "pad" and "mattress" are used interchangeably herein. A snug fitting mattress or pad is typically placed on top of the bottom support. The slatted side rails have openings between the slats through which a child can extend its arms or legs. Additionally, most cribs lack a top covering.

Openings associated with slatted side rails and open crib tops may create safety problems. First, older children can climb out the top of open cribs and playpens, subjecting them to possible injury from falls and allowing them to wander into other areas of the house and be exposed to other dangers. A child may extend an arm or leg outside of a crib through the slats and suffer injury such as a fracture. Also, the child may simply have difficulty drawing its arm or leg back into the crib and become chilled because the limb is uncovered. Pets have also been known to gain access to the interior of cribs and playpens through such openings and inflict harm to a child.

SUMMARY OF THE INVENTION

It is an object of this invention to provide a mesh enclosure that safely enclose the interior of a crib or playpen.

One object of this invention is to provide an enclosure that safely confines a child within a crib and facilitates moving a child in or out of the crib.

Another object of this invention is to provide an enclosure to safely line the interior surface of a crib or playpen and provide a protective structure that covers the top thereof.

One embodiment of the invention comprises an enclosure for a crib or playpen having a headboard, a footboard, side rails, a bottom support and a pad or a mattress. The enclosure has a box-shaped body made of a flexible mesh fabric having a bottom panel, side panels, end panels and a dome-shaped top comprising a plurality of bowed ribs for supporting a top netting in the form of a tent. The box-shaped body of the enclosure fits over the top of the bottom support and inside the headboard, footboard and side rails of a crib. The top netting is connected to the box shaped body and serves to create a completely enclosed area inside of the crib. The top netting includes a flap with a zippered fastener that children cannot access easily from the inside of the enclosure. The zippered fastener is difficult to access because of its position on the top and in some embodiments by the presence of a taut zipper liner or alternatively a zipper pocket on the interior side of the flap near the closed end of the zipper. The opening and the fastener also have the beneficial feature of being placed at an appropriate height for adults and are further arranged for ergonomic use. The fastener opens from right to left, which makes it easier for most adults to open while holding a child.

Another embodiment of the invention includes features for safely securing the enclosure to the structure of the crib. These features include the bottom panel which is held in place by the mattress or pad of the crib or playpen. They may also include end panel straps arranged to hold the enclosure to the footboard and headboard of the crib and side rail straps designed to attach it to the crib side rails.

In another embodiment of the invention, an enclosure for use with a crib having a headboard, a footboard, a pair of side rails, a bottom support and a pad is disclosed. The enclosure comprises a box-shaped body made of fabric and has a bottom panel, a pair of side panels, and a pair of end panels for fitting over the bottom support and inside of the headboard, the footboard, and the pair of side rails. The crib provides structure to the box-shaped body. The enclosure also comprises a dome-shaped top comprising fabric and a semi-rigid support rod for supporting the fabric. The dome-shaped top is removably attachable to the box-shaped body.

In still another embodiment of the invention, an enclosure for use with a crib having a headboad, a footboard, a pair of side rails, a bottom support, and a pad is disclosed. The enclosure comprises a box-shaped body made of fabric and has a bottom panel, a pair of side panels, and a pair of end panels for fitting over the bottom support and inside of the headboard, the footboard, and the pair of side rails. The enclosure also comprises a dome-shaped top attached to the box-shaped body. The dome-shaped top comprises a semi-rigid continuous loop as a support rod, fabric, and a sleeve for holding the semi-rigid continuous loop. The dome-shaped top is constructed and arranged to be configured in either a collapsed configuration for storage or an operative configuration for use with the crib with the semi-rigid continuous loop providing structure to the dome-shaped top.

These and other objects and features of the present invention will be better understood and appreciated from a reading of the following detailed description of an embodiment thereof shown in the accompanying drawings.

BRIEF DESCRIPTION OF THE DRAWINGS

FIG. 6 is an enlarged exterior view taken along sight line 6 in FIG. 2 showing a zipper pocket with the zipper mechanism in the closed position.

FIG. 7 is a cross-sectional view of the zipper pocket taken along section lines 7—7 in FIG. 6.

FIG. 8 is an enlarged exterior view taken along sight line 6 in FIG. 2 showing another embodiment of the zipper pocket with the zipper mechanism in an open position.

DETAILED DESCRIPTION

Figure 1:
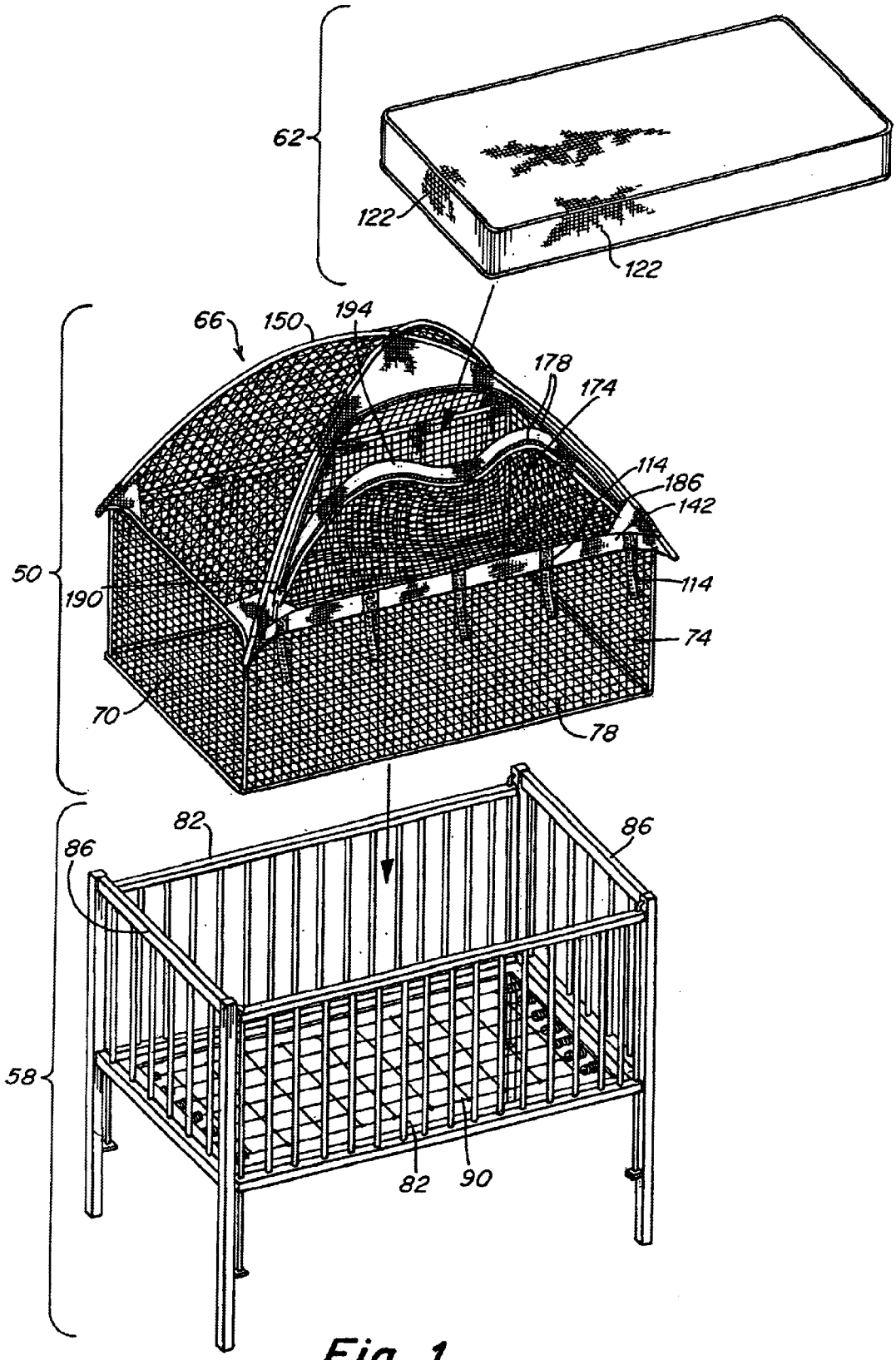
FIG. 1 is an exploded perspective view of one embodiment of the protective enclosure, along with a crib and mattress with which it may be used.

The crib enclosure 50 of the present invention is adapted to help a parent or guardian keep a child safely within the interior of a crib. The enclosure may prevent a child from injuring themselves while in a crib. Additionally, the enclosure can prevent a child from escaping from a crib, where they may be injured.

The enclosure is generally sized so that its base dimensions are consistent with the length and width of the bottom pad 62 typically used in cribs 58. The enclosure 50 comprises a dome-shaped top 66, and a box-shaped body. The box-shaped body comprises two opposed end panels 70, two opposed side panels 74 and a bottom panel 78. The panels 70, 74, 78 and the top 66 may be attached to the various components of the crib 58, including side rails 82, headboard and footboard 86, and bottom support 90. Both the end panels 70 and the side panels 74 are designed to be roughly the same height as the interior of a standard crib 58. The dome shaped top 66 of the enclosure 50 is set at a height that will allow a young child to stand unobstructed inside the crib 58.

Figure 2:
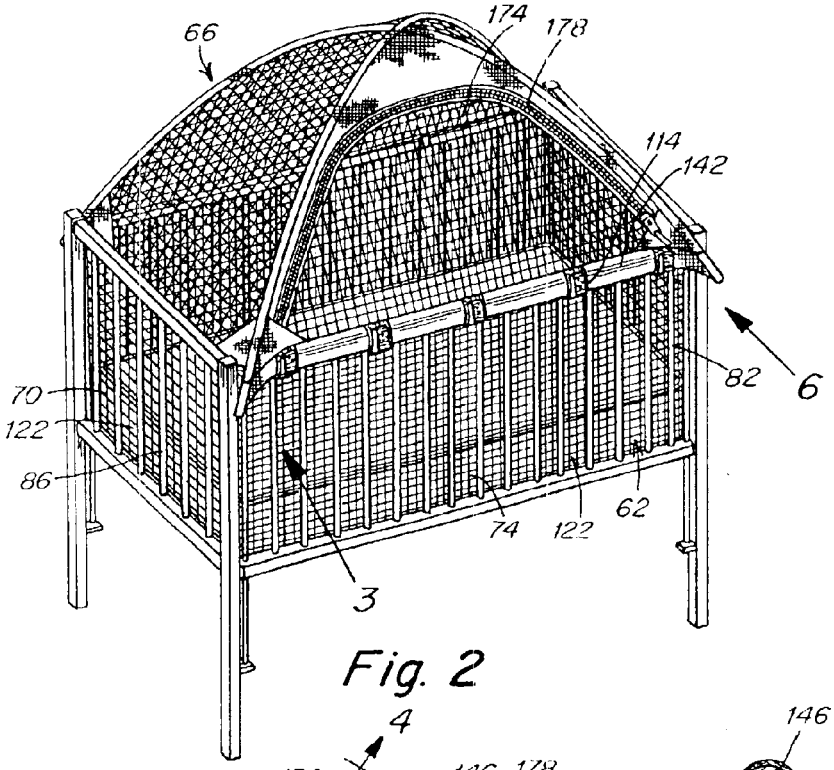
FIG. 2 is a perspective view of the embodiment of FIG. 1 mounted in a crib and with the flap in a closed position.
Figure 12:
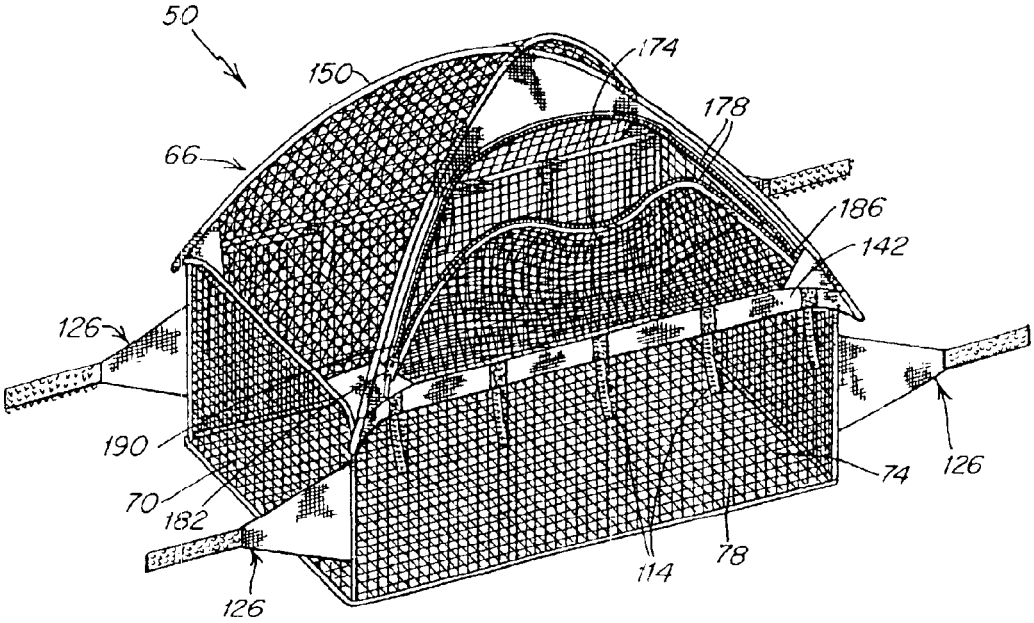
FIG. 12 is a perspective view of one more embodiment of the protective enclosure with the end panel straps and the flap in an open position.
Figure 13:
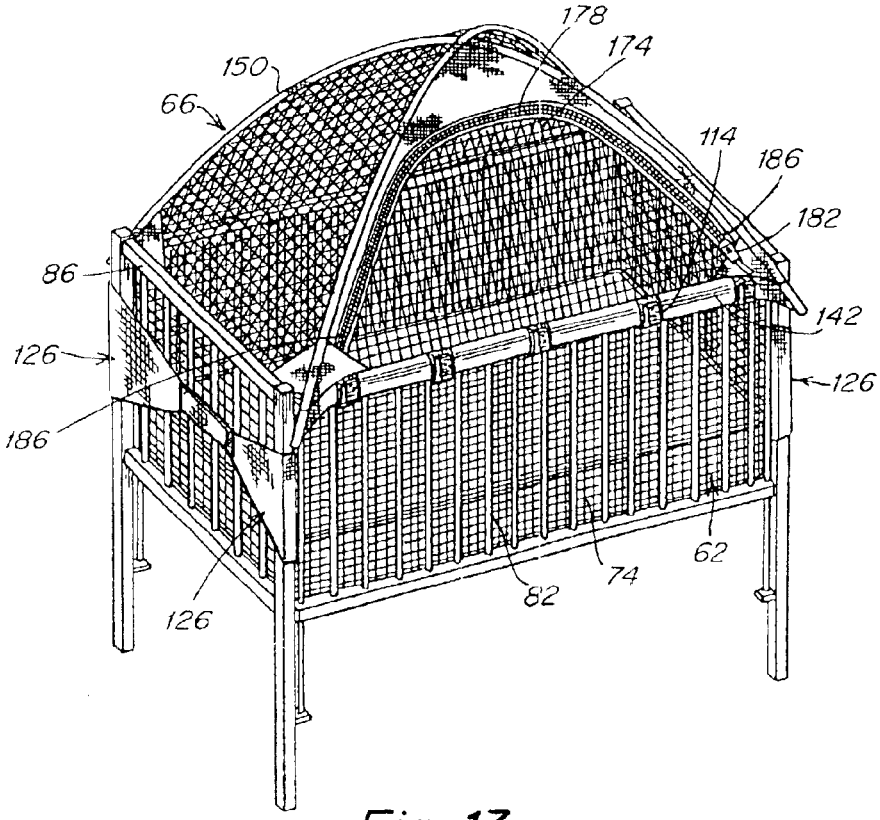
FIG. 13 is a perspective view of the embodiment of FIG. 12 mounted in a crib with the end panel straps and side rail straps secured.
Figure 14:
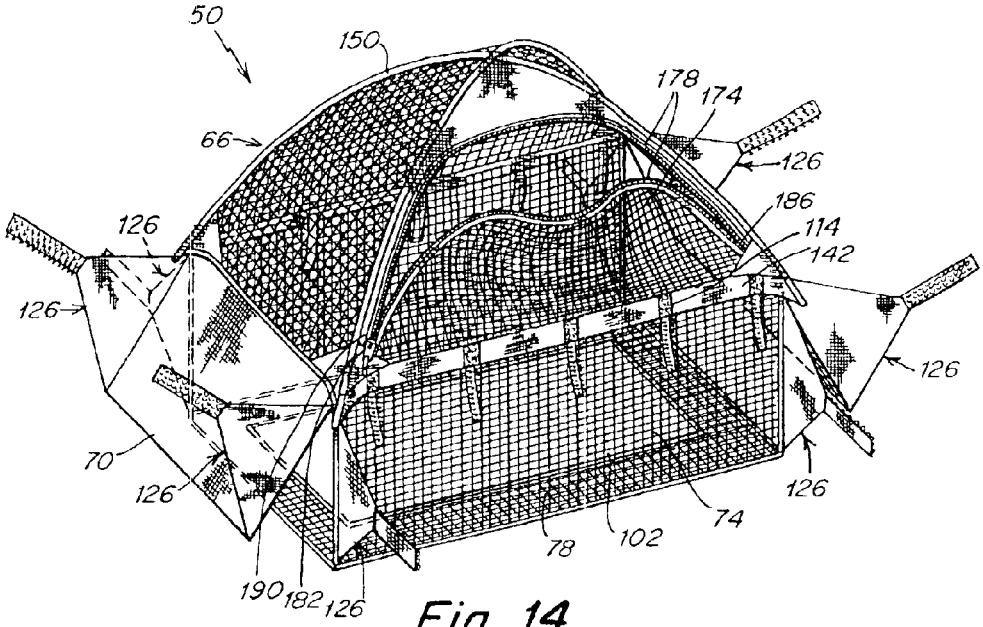
FIG. 14 is a perspective view of yet another embodiment of the protective enclosure showing end panels and side panels that are not directly connected and that have multiple end panel straps.
Figure 15:
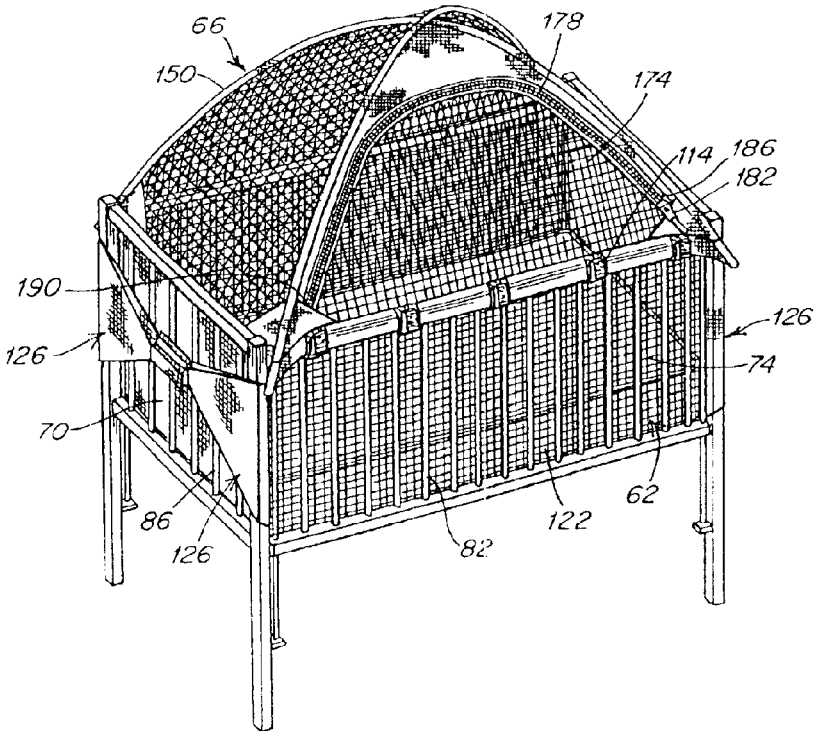
FIG. 15 is a perspective view of the embodiment of FIG. 14 mounted in a crib.

The protective enclosure 50 confines a child to the inside of the crib 58. This is accomplished by lining the interior surfaces of the crib with the box-shaped body of the enclosure and by covering the top of the crib with the dome-shaped top. Although the dome-shaped top takes the form of a dome in most embodiments, it may also be formed of different shapes, as the descriptive term "dome-shaped" is not limiting. Additionally, a flap 174 may exist on the top that can be selectively opened, as shown in FIGS. 1, 12, and 14, to allow a child and/or objects to be placed into and removed from the interior of the crib, or closed as shown in FIGS. 2, 13, and 15.

Figure 9:
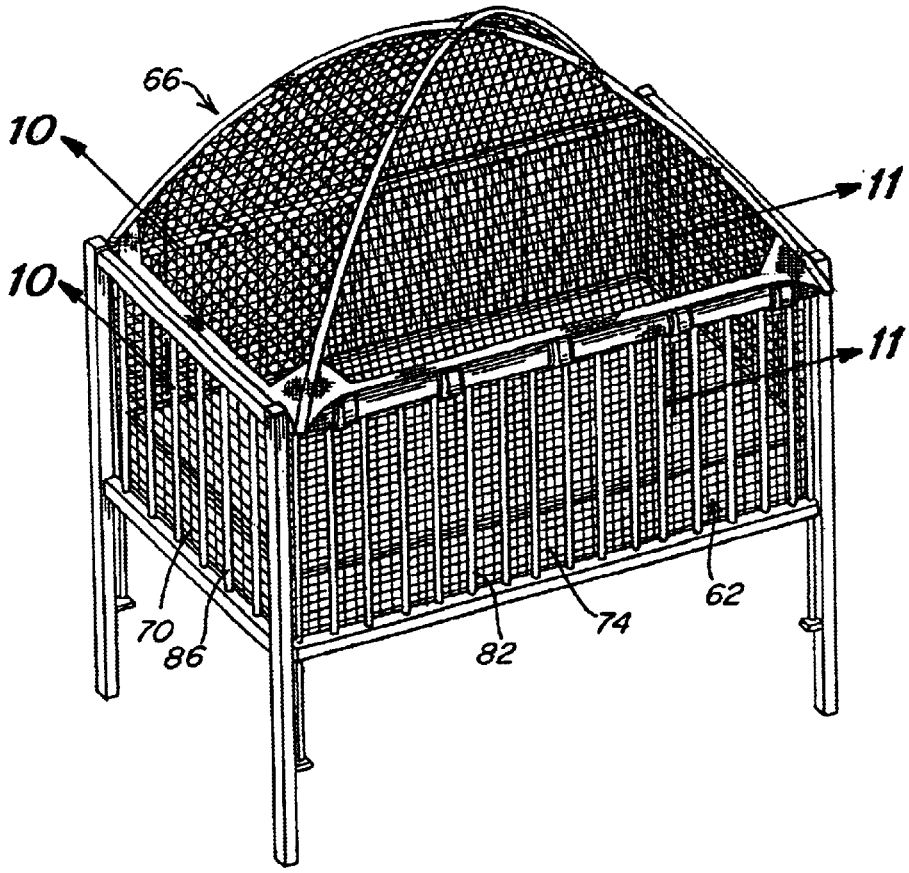
FIG. 9 is a perspective view of the backside of yet another embodiment of the protective enclosure mounted in a crib.
Figure 10:
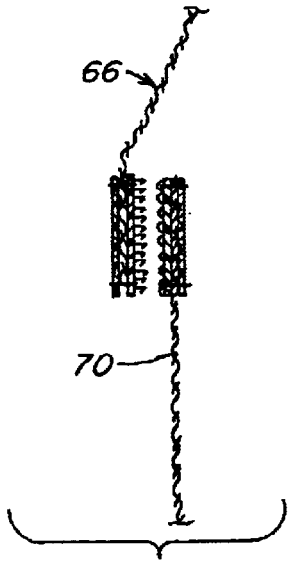
FIG. 10 is a cross sectional view taken along section line 10—10 in FIG. 9 showing one type of connection that may be used between end panels and top.
Figure 11:
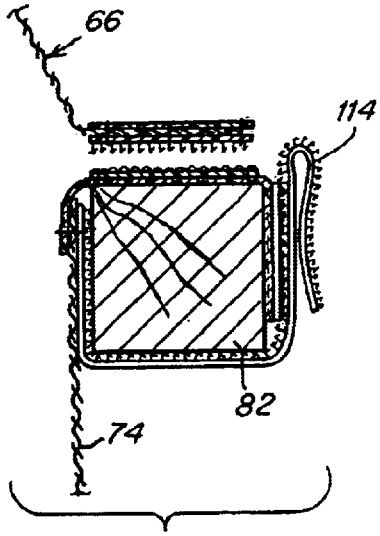
FIG. 11 is a cross sectional view taken along section line 11—11 in FIG. 9 showing one connection embodiment that may be used between the top, the side panels and the side rails.
Figure 16:
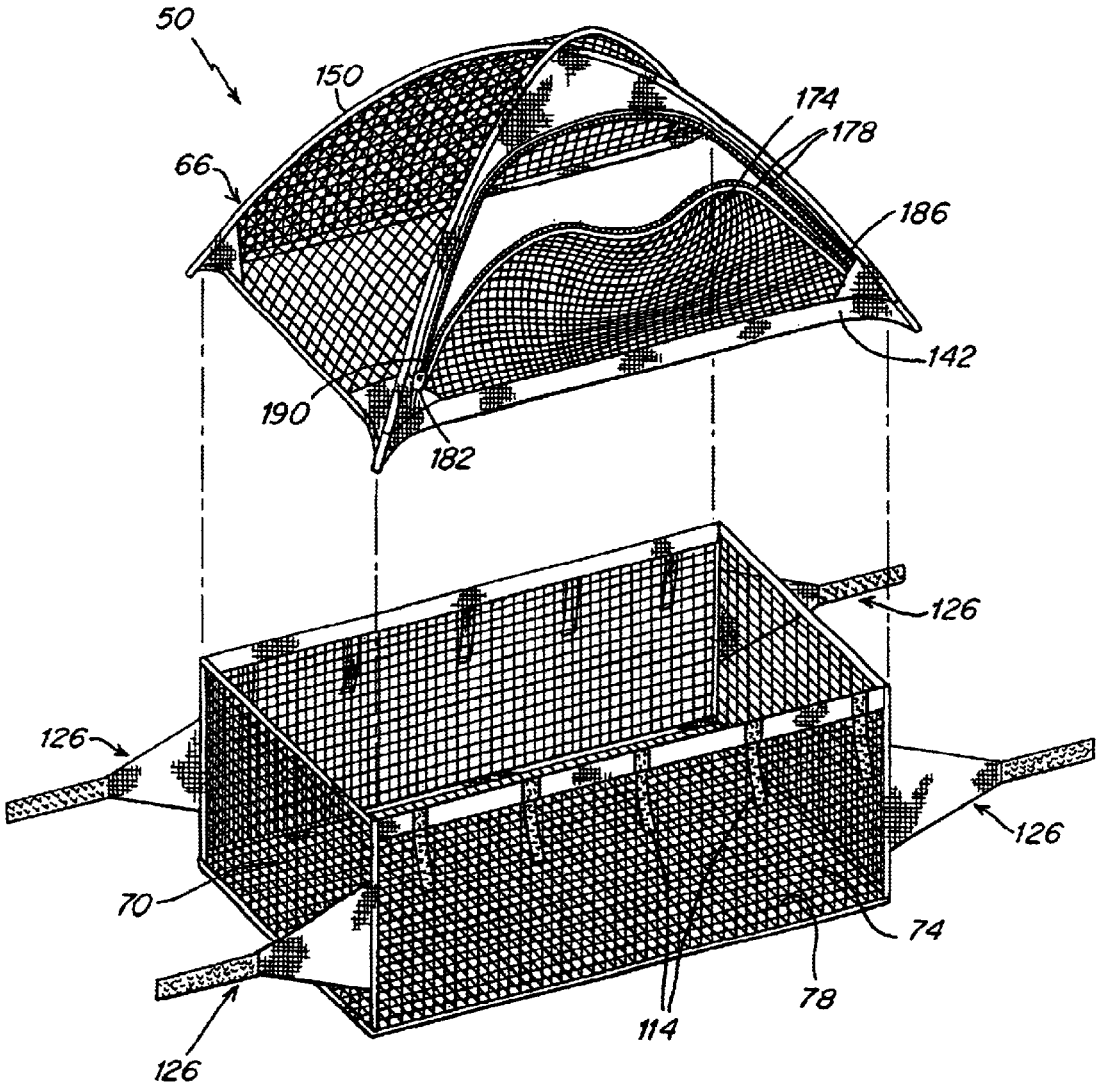
FIG. 16 is a perspective view of an embodiment of a protected enclosure having a top that is removable from the body of the enclosure.

Although in most embodiments the box-shaped body comprises continuous material forming five sides of a continuous rectangular shape, other embodiments may have different variations. For instance, the bottom panel 78 may only extend under a margin of the pad 62, thus creating an opening 102 to reduce the amount of material required, as shown in FIG. 14. In such embodiments the mattress or pad 62 will cover the opening in the bottom panel when the enclosure 50 is installed in a crib 58 as shown in FIGS. 2, 9, 13, and 15. Some embodiments of the enclosure may not have panels that are permanently connected on all of their adjacent edges. One such non-permanent connection is shown in FIGS. 10, 11, and 16 where a VELCRO type (hook and loop) material is used to connect the box-shaped body to the dome-shaped top. FIG. 14 shows yet another embodiment having the end panels 70 and the side panels 74 that are not directly connected to one another. The end panels and side panels in this embodiment are held tightly against one another when installed in the crib as shown in FIG. 15. This prevents a child from placing its arms or legs outside of the crib or otherwise becoming entangled at the intersection between the end panels 70 and the side panels 74.

While the invention in the several embodiments completely encloses the interior 54 of the crib 58, a flap 174 may exist on the top 66 and can be left open for children that are too small to stand or otherwise reach the top of the enclosure 50. Similarly, the top of the enclosure may also be removed from the bottom in some embodiments having a removable top as illustrated in FIG. 16, when children are supervised, or do not require supervision.

The structure of the enclosure 50 is generally made of cloth material and may be made of mesh cloth. In some embodiments, portions of the covering may be layered with a solid, reinforcing fabric such as a taffeta lining, or may even be replaced with such fabric. This may be done at such locations as the end panels 70 as shown in FIG. 14, end panel straps 126, and side rail straps 114 or at the reinforcement strips 142 adjacent the top of the side rails 82, as shown in FIGS. 12 and 13. Other portions of the enclosure 50 may also be reinforced.

Before installing the enclosure 50, the pad 62 is removed from the crib. The enclosure is then placed inside the interior of the crib 58. In embodiments where the top of the enclosure is permanently attached to the bottom, the pad 62 is usually inserted through the opening created by the flap 174 and then laid on top of the bottom panel 74 to hold it in position. In embodiments with a removable top, the pad may be placed into the crib when the top of the enclosure is removed or through a flap on the top. The side panels 74 and end panels 70 are designed to fit snugly around the sides 122 of the pad 62 to prevent an infant or sundry items in the crib 58 from being lodged between the pad 62 and the side/end panels 70, 74 of the enclosure 50.

The enclosure may also be secured to the crib with additional fastening elements. End panel straps 126 that help attach the enclosure 50 to the crib can be connected to the enclosure 50 near the intersection of the end panels 70 and side panels 74. These straps 126 may wrap completely around the headboard or footboard 86 and may be tied together or otherwise connected to one another with VELCRO (hook and loop fasteners), snaps, buttons, or any other comparable fasteners. In one embodiment, as shown in FIGS. 14 and 15, the side panels 74 are not directly connected to the end panels 70. However, this embodiment has two sets of straps 126 at each end of the enclosure 50. One set is associated with the end panels 70 and one set is associated with the side panels 74. Each of these sets of straps 126 are wrapped around the headboard or footboard 86 and fastened together to eliminate any openings in the enclosure 50. In other embodiments, as shown in FIGS. 1, 2, and 9, no such straps 126 are used.

The top edges of the side panels 74 may also be secured to the top bar of the side rails by multiple side rail straps 114. In the illustrated embodiment, there are five side rail straps 114 on each of the two side rails 82, although any number can be used. The side rail straps 114 are shown to include a VELCRO fastener (hook and loop material) although other types of fastener may be used. In embodiments having a removable top, these side rail straps may also serve to secure the enclosure top to the box-shaped body. The side rail straps 114 are anchored to the reinforcing strip 142 which runs the length of the side panels adjacent to the top of the side rail 82 in the illustrated embodiment. In the preferred embodiment, this reinforced strip 142 is made of taffeta, although other materials may be used.

Figure 3:
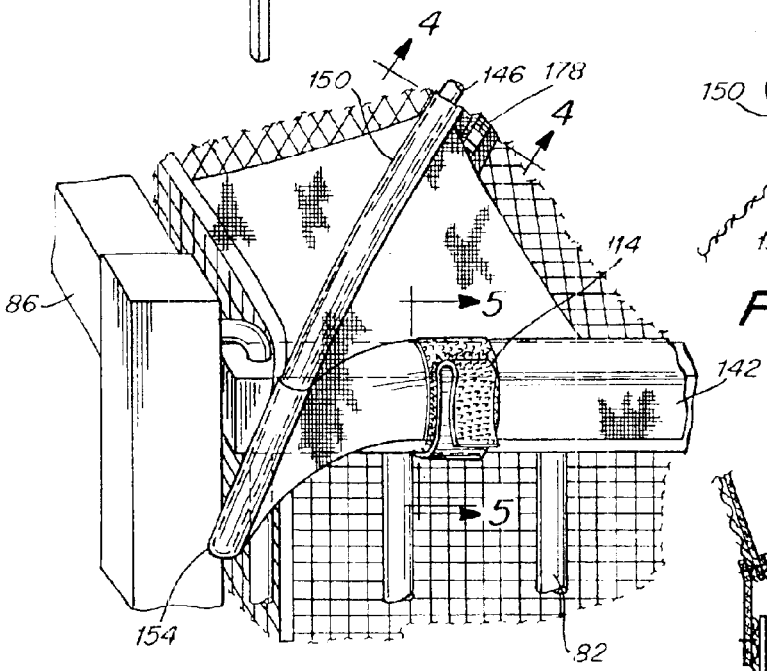
FIG. 3 is an enlarged perspective view of the front left corner of the protective enclosure assembled in a crib as viewed along sight line 3 in FIG. 2.

The top 66 of the enclosure 50 comprises a dome-shaped structure. The structure is supported by one or more semi-rigid ribs 146, each held firmly to the enclosure 50. In one embodiment of the invention, the ribs 146 are inserted into sleeves 150 of the enclosure 50 which end in pockets 154 near each corner of the top 66 as shown in FIG. 3. The pockets 154 at the corners of the enclosure 50 and the sleeves 150 hold the ribs 146 in a manner that causes them to bow into a desired shape. This bowed shape of the ribs 146 defines the dome-shaped structure of the top 66 of the enclosure 50. When the ribs 146 are removed from the sleeves 150, the enclosure will be unstructured and may be rolled or compressed for storage. While continuous sleeves 150 are shown in the preferred embodiment, multiple smaller sleeves, hooks or other fasteners may be used in place of the continuous sleeve.

Figure 17:
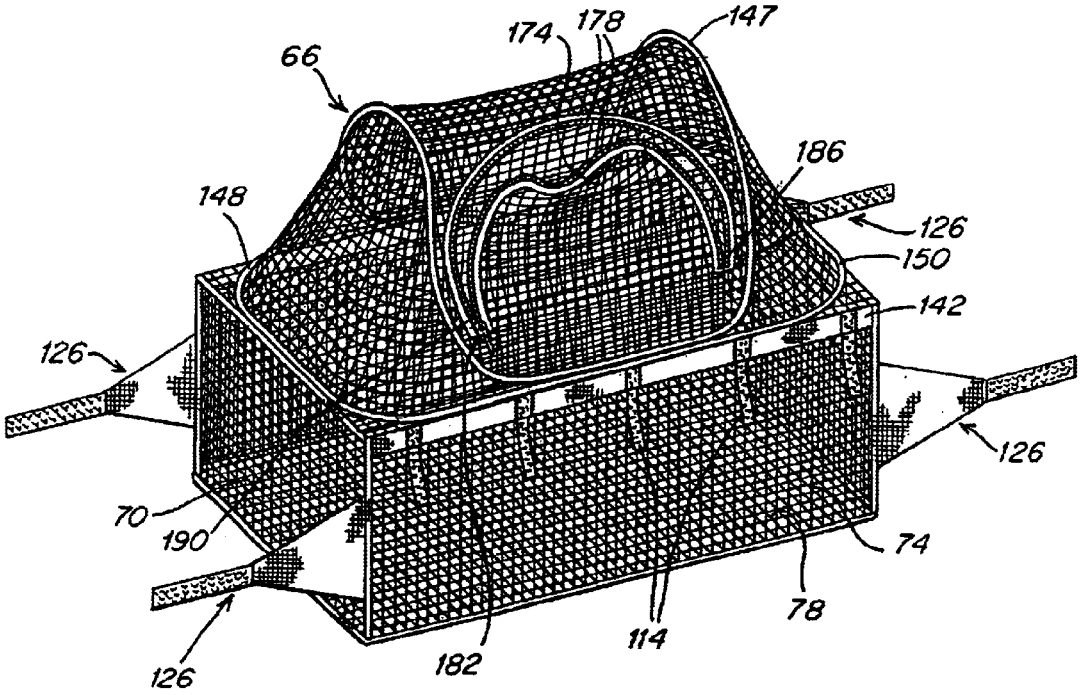
FIG. 17 is a perspective view of an embodiment of the protective enclosure having a dome-shaped top supported by two, semi-rigid, continuous loops.

In another embodiment as shown in FIG. 17, the top 66 of the enclosure 50 comprises a dome-shaped structure supported by a pair of semi-rigid, continuous loops 147, 148. Each of these loops are enclosed in a sleeve 150 made of fabric. Although in some embodiments these continuous loops may be disassembled and removed from the sleeves, they may also remain in the sleeves when the dome-shaped top is configured in its operative position, as illustrated in FIG. 17, and when it is in its collapsed position for storage. FIG. 17 shows a first continuous loop 147 that provides structure to the upper portion of the top and a second continuous loop 148 that resides near the side rails and the ends of the crib to facilitate securing the top to the crib in addition to providing some structure to the top.

Figure 18:
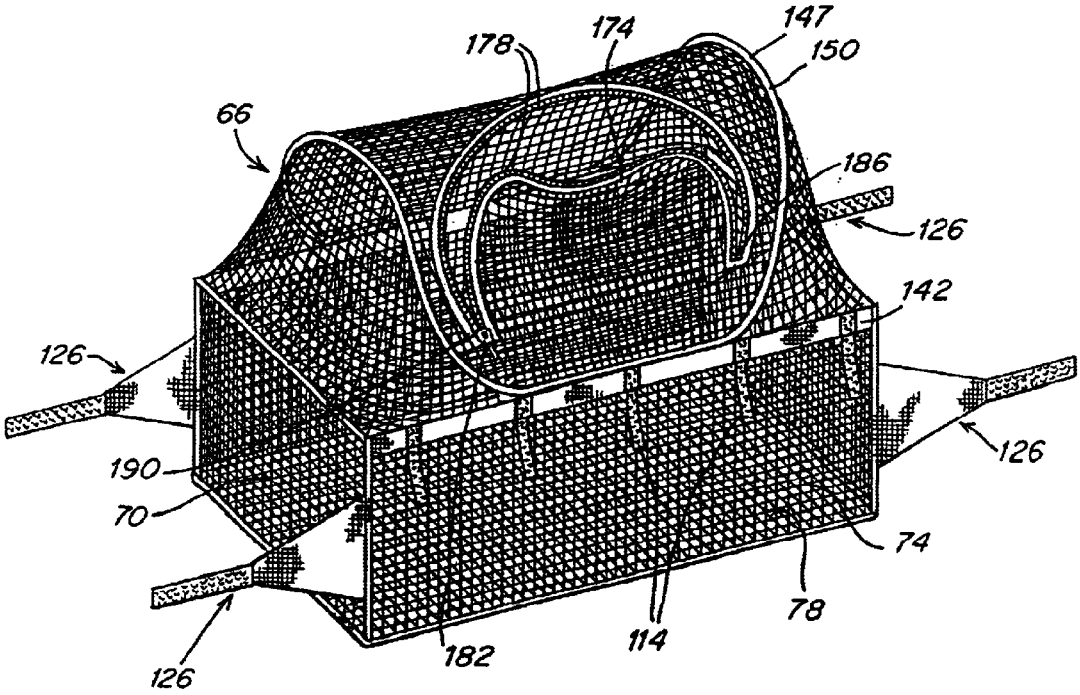
FIG. 18 is a perspective view of another embodiment having a dome-shaped top supported by one, semi-rigid, continuous loop.

FIG. 18 shows another embodiment having only one semi-rigid, continuous loop 147 that provides structure to the top. The continuous loop of this embodiment may be fastened to the side rails 82 in order to secure the top 66 to the crib 58. The top of each of the embodiments shown in FIGS. 17 and 18 may be either removably attached to the bottom as in FIG. 16 or permanently attached to the bottom. Additionally, the top may have an openable flap 174 to allow a child or objects to be placed into or removed from the crib. The flap, as shown in both of FIGS. 17 and 18, is generally in the shape of an inverted 'U', however, some embodiments may include flaps having different shapes or have no flap at all.

Figure 19A:
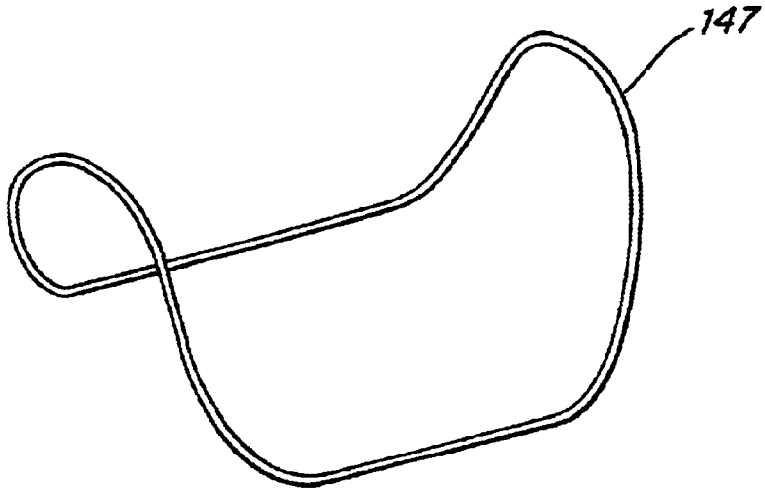
FIGS. 19A–19C show the process of collapsing a semi-rigid continuous loop for storage.
Figure 19B:
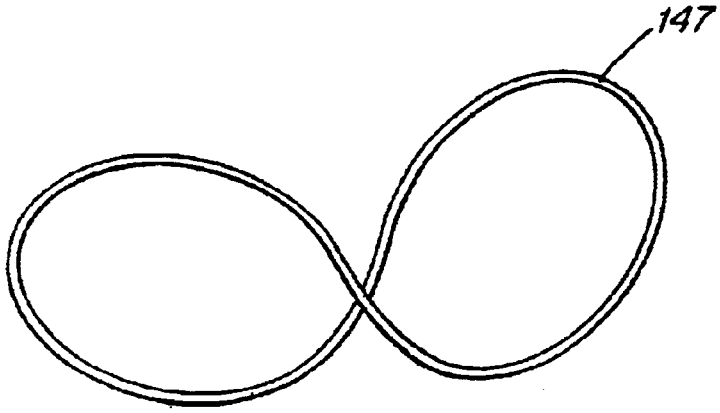
Figure 19C:
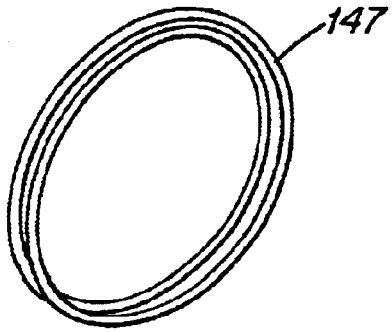

Embodiments of the invention shown in FIGS. 17 and 18 having a semi-rigid, continuous loop may be collapsed for storage without removing the continuous loop from its sleeve 150. To accomplish this, the structure is first removed from the crib. FIG. 19*a* represents a semi-rigid, continuous loop 147 as it is shaped when the top is in its operative position. The loop or loops are then folded into a figure-8 configuration as represented in FIG. 19*b*. Once in the form of a figure-8, each of the loops of the figure-8 are then folded on top of one another such that the semi-rigid loop takes on the form of a single smaller loop as shown in FIG. 19*c*. This process may be continued to reduce the size of the final set of overlapped loops. The fabric of the top and the bottom of the enclosure may be bundled or wrapped around this final loop and thereafter placed in a container for storage. Such a container may be circular and thus consistent with the shape of the folded loop, or it may be of a different shape as the invention is not limited in this respect. In other embodiments, the enclosure itself may include a loop-shaped pocket incorporated into the top or box-shaped body that can be used as a storage container.

A flap 174 is included in the dome shaped top 66 adjacent to one of the side panels 74 of some embodiments. This flap 174 includes a zipper closure 178 in the illustrated embodiments, although other fasteners can be used. The flap 174 is generally shaped like an inverted 'U' with its closed zipper end 186 and open zipper end 190 terminating near and above the top of the side rails 82. The ends of the flap 174 are set at a height to help prevent a child from accessing the flap 174 or the zipper closure 178. The zipper 178 is arranged to open from right to left as the user is facing the covering from outside, thus placing the slide 182 of the closed zipper on the right side. This arrangement is preferable because most adults prefer to operate the zipper 178 with their right hand while supporting the child in their left arm.

Figure 4:
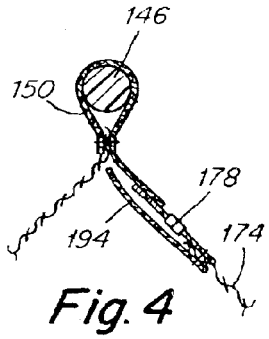
FIG. 4 is a cross-sectional view taken along section line 4—4 in FIG. 3 showing a zipper with a taut liner.
Figure 5:
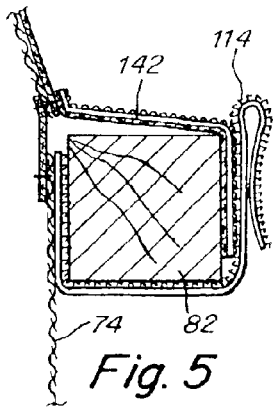
FIG. 5 is a cross sectional view taken along section line 5—5 in FIG. 3 showing a VELCRO-type (hook and loop) strap connecting the enclosure to the side rail of the crib.

In some embodiments as shown in FIG. 4, there is a taut liner 194 on the interior of the flap 174 that further prevents a child from accessing the zipper 178 or the zipper slide mechanism 182 from the inside. This liner 194 is connected to the interior of the flap 174 on at least the lower side of the zipper 178. The uppermost side of the liner 194 is left free so that it does not interfere with the operation of the zipper 178. This arrangement makes it more difficult for a child to access the zipper slide mechanism 182 or zipper 178 as it requires the child to reach over the top edge of the liner 194 before gain access can be gained. This prevents the child from playing with the zipper mechanism 182 and injuring him or herself or from opening the zipper from the inside.

In some embodiments, as is shown in FIG. 8 there is a zipper pocket 198 located on the closed end 186 of the zipper 178. In the preferred embodiment, this is also the right hand side of the zipper. This pocket is made by attaching a lining material 130 on the interior side of the enclosure 50. The lining material 130 is sewn into the top of the enclosure around a portion of the periphery of the closed end of the zipper as shown by the stitches 134 in FIG. 8. The pocket provides a protective environment for the zipper mechanism 182 when it is positioned at the closed end 186 of the zipper 178. It prevents a child from reaching the zipper while the child is inside the enclosure, thus preventing the child from operating the zipper. The pocket extends a short distance 'D1' from the closed end 186 of the zipper 178 as shown in FIG. 6, while in other embodiments such as shown in FIG. 8, the pocket 198 extends a much greater length 'D2'. FIG. 7 depicts the cross section of the pocket when the zipper is closed. It is noted that the pocket as shown in FIG. 7 contains a certain amount of slack when the flap 174 is closed, although other embodiments may have more or less slack.

From the foregoing description those skilled in the art will appreciate that numerous modifications may be made of the preferred embodiment shown in the drawings without departing from the spirit of this invention. For instance, the dome-shaped top and the box-shaped bottom may be made as completely separable entities that are each independently attached to the crib. Therefore, it is not intended that the scope of the invention be limited to the specific embodiment illustrated, but rather its scope is to be determined by the appended claims and their equivalents.

What is claimed is:

1. An enclosure for use with a crib having a headboard, a footboard, a pair of side rails, a bottom support and a pad, the enclosure comprising:

a box-shaped body made of fabric and having a bottom panel, a pair of side panels and, a pair of end panels for fitting over the bottom support and inside of the headboard, the footboard and the pair of side rails, wherein the crib provides structure to the box-shaped body; and a dome-shaped top comprising fabric and a semi-rigid, support rod for supporting the fabric, wherein the dome-shaped top is removably attachable to the box-shaped body.

2. The enclosure of claim 1 further comprising a closable aperture disposed on the dome-shaped top adjacent to a side panel.

3. The enclosure of claim 2 further comprising a zipper mechanism for opening and closing the closable aperture.

4. The enclosure of claim 1, further comprising hook and loop fasteners for removably attaching the dome-shaped top to the box-shaped body.

5. The enclosure of claim 1, wherein the semi-rigid, support rod comprises a semi-rigid, continuous loop.

6. The enclosure of claim 5, wherein the dome-shaped top can be collapsed for storage.

7. The enclosure of claim 6, wherein dome-shaped top further comprises a fabric sleeve for retaining the semi-rigid, continuous loop when the dome-shaped top is collapsed.

8. The enclosure of claim 7, wherein the semi-rigid continuous loop is retained within the fabric sleeve while the dome-shaped top is collapsed for storage.

9. The enclosure of claim 7, wherein the semi-rigid, continuous loop comprises multiple, semi-rigid continuous loops.

10. The enclosure of claim 7, wherein the dome-shaped top is adapted to be collapsed by bending the semi-rigid, continuous loop into a folded, figure-eight configuration.

11. An enclosure for use with a crib having a headboard, a footboard, a pair of side rails, a bottom support, and a pad, the enclosure comprising:

a box-shaped body made of fabric and having a bottom panel, a pair of side panels, and a pair of end panels for fitting over the bottom support and inside of the headboard, the footboard, and the pair of side rails; and a dome-shaped top attached to the box-shaped body, the dome-shaped top comprising a semi-rigid, continuous loop as a support rod, fabric, and a sleeve for holding the semi-rigid continuous loop, the dome-shaped top being constructed and arranged to be configured in either a collapsed configuration for storage or an operative configuration for use with the crib with the semi-rigid continuous loop providing structure to the dome-shaped top.

12. The enclosure of claim 10, wherein the crib provides structure to the box-shaped body.

13. The enclosure of claim 11, further comprising a closable aperture disposed on the dome-shaped top adjacent to a side panel.

14. The enclosure of claim 11, further comprising a zipper mechanism for opening and closing the closable aperture.

15. The enclosure of claim 11, wherein the fabric sleeve is adapted to retain the semi-rigid continuous loop in both the collapsed configuration and the operative configuration.

16. The enclosure of claim 15, wherein the semi-rigid, continuous loop is retained within the fabric sleeve while the dome-shaped top is changed from the collapsed configuration to the operative configuration.

17. The enclosure of claim 16, wherein the semi-rigid, continuous loop comprises multiple, semi-rigid, continuous loops.

18. The enclosure of claim 16, wherein the dome-shaped top is constructed and arranged to be configured in its collapsed configuration by bending the semi-rigid, continuous loop into a folded, figure-eight configuration.

19. The enclosure of claim 11, wherein the dome-shaped top is removably attachable to the box-shaped body.

* * * * *